US006439741B1

(12) United States Patent
Diaz et al.

(10) Patent No.: US 6,439,741 B1
(45) Date of Patent: Aug. 27, 2002

(54) LUMINAIRE OF ELONGATE SHAPE

(76) Inventors: José Diaz, 59, Bd Jacques Duclos, 58000 Nevers (FR); Thierry Fleury, 15, rue du Rivage, 58000 Nevers (FR); Serge Lavergne, 156 rue D. Michel, 58260 La Machine (FR)

( * ) Notice: Subject to any disclaimer, the term of this patent is extended or adjusted under 35 U.S.C. 154(b) by 0 days.

(21) Appl. No.: 09/566,974

(22) Filed: May 9, 2000

(30) Foreign Application Priority Data

May 11, 1999 (FR) ..... 99 06017

(51) Int. Cl.[7] ..... F21V 21/04

(52) U.S. Cl. ..... 362/217; 362/374; 362/220; 362/260; 362/222; 362/221

(58) Field of Search ..... 362/220, 374, 362/372, 217, 221, 222, 260

(56) References Cited

U.S. PATENT DOCUMENTS 3,525,544 A * 8/1970 Jacobs ..... 292/18
5,997,158 A * 12/1999 Fischer et al. ..... 362/374
6,264,348 B1 * 7/2001 Ellis ..... 362/375

FOREIGN PATENT DOCUMENTS

DE 1028688 10/1956

* cited by examiner

*Primary Examiner*—Sandra O'Shea
*Assistant Examiner*—Anabel Ton
(74) *Attorney, Agent, or Firm*—Frank J. Keegan

(57) ABSTRACT

A luminaire of elongate shape comprising a roof (1) and an elongate plate (4) which supports internal functional elements (7, 9, 10) of the luminaire.

Each of the longitudinal edges of the plate (4) is provided with contact portions (3) which are turned towards the interior of the roof when the plate is in the normal operational position, while the roof is provided with hooks (8L, 8R) which face the contact portions (3) and which each have a support portion (6) which is designed to support the contact portion (3) when the plate is in the open position.

19 Claims, 3 Drawing Sheets

LUMINAIRE OF ELONGATE SHAPE

BACKGROUND OF THE INVENTION

The invention relates to a luminaire of elongate shape comprising a housing with at least a half shell referred to as "roof" which is provided with means for fastening to any support, and an elongate plate which supports internal functional elements of the luminaire.

A luminaire comprising a roof of elongate shape is known from the document DE 1 028 688. According to this document, a first and a second group of bolts are placed along each major side of the roof, and a mechanical connection between the two groups renders it possible to place one group in a release position for a transparent half shell usually called cover, while the other group is simultaneously placed in a retention position for the open cover, which renders it possible, the luminaire being fastened below a horizontal surface, for the cover to remain connected to the roof, for example during the replacement of a lamp.

SUMMARY OF THE INVENTION

It is an object of the invention to render servicing activities on the luminaire easier, especially its installation, by rendering it possible for the plate to pivot while it remains attached. The invention provides a known hooking effect, but employs more economical means which are applied to the plate.

To achieve the above object, each of the longitudinal edges of the plate is provided with portions referred to as "contact portions" which are turned towards the interior of the roof when the plate is in its normal operational position, and the roof is provided, opposite said contact portions, with support pieces which each have a support portion capable of supporting a contact portion of the plate when the latter is detached from the roof and pivoted with respect to the roof.

Special embodiments of the invention will appear from the dependent claims 2 to 6.

These as well as other, more detailed aspects of the invention will become clear from the following description of an embodiment which is given by way of non-limitative example.

DETAILED DESCRIPTION OF THE PREFERRED EMBODIMENTS

Figure 1:
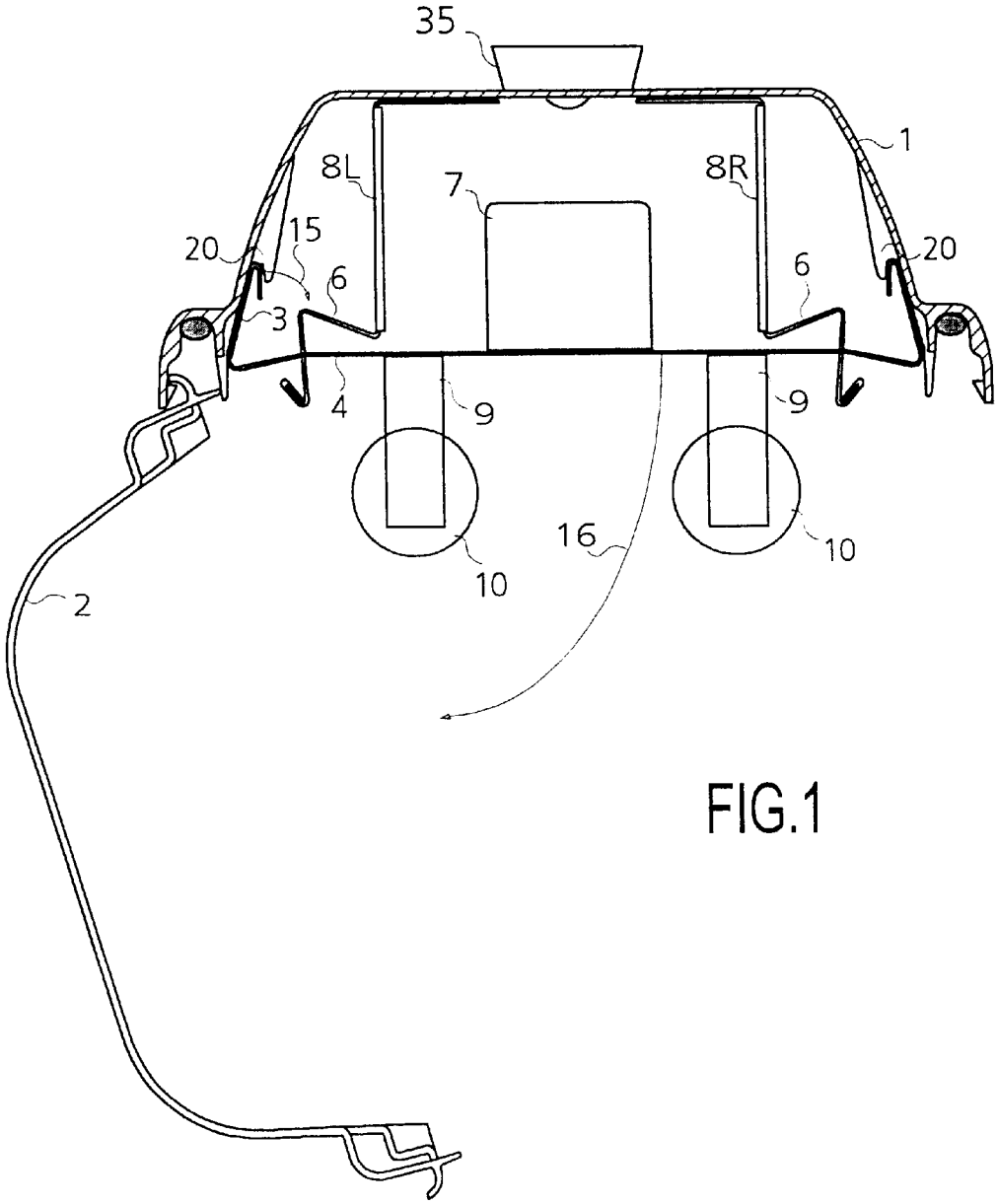
FIG. 1 shows a luminaire with its cover open and the plate in normal operational position in cross-section.

The luminaire of FIG. 1 comprises inter alia

- a housing comprising a half shell 1 referred to as "roof" and provided with fixation means 35 for fastening to any support, for example to a ceiling,
- a transparent half shell or "cover" 2, here pivoted to the left to provide access to the interior of the luminaire,
- a plate 4 made from profiled metal sheeting and supporting internal functional elements of the luminaire: inter alia a ballast 7 and lampholders 9 for fluorescent tubes 10.

Each of the longitudinal edges (perpendicular to the plane of drawing) of the plate 4 is provided with a folded portion 3 referred to as "contact portion". This folded portion 3 is turned towards the interior of the roof 1 when the plate is in its normal operational position as shown here.

Retention elements 20 are provided in the roof for engaging with the upper sides of the portions 3 for preventing the latter from bending themselves into the interior of the luminaire.

The roof 1 is provided with support pieces 8L, 8R, each having a support portion 6.

Figure 2:
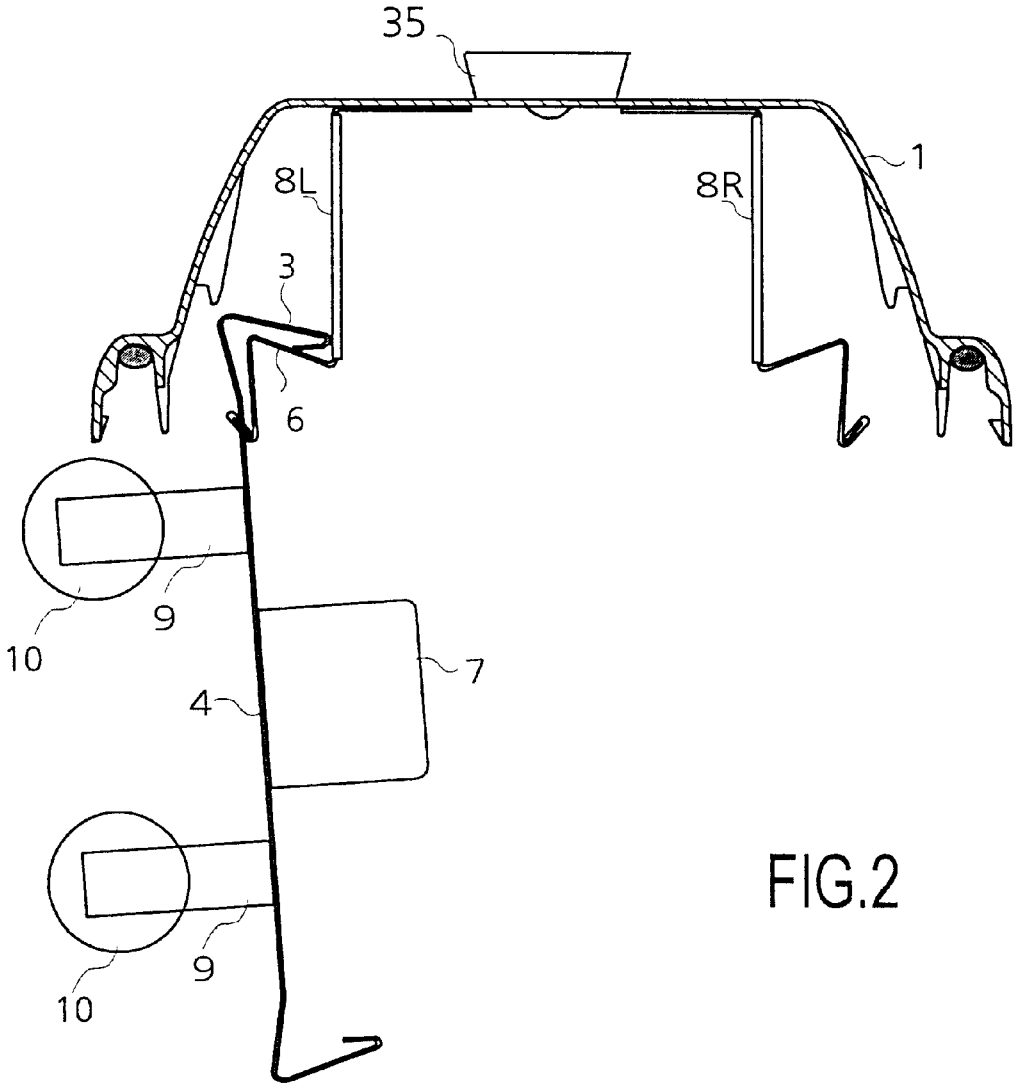
FIG. 2 shows the luminaire with the cover removed and the plate in lowered position, which position is used when the luminaire is being maintenance.

FIG. 2 shows the same luminaire in a position in which the plate 4 has been pivoted to the left together with the elements supported thereby. The cover has been removed so as to allow the plate to pivot completely into a vertical position. The folded portion 3 of the plate is held by the support portion 6 of the support piece 8L. It is clear that the system is symmetrical and that the same plate might just as well be pivoted to the right, then remaining hooked behind the support piece 8R on the right.

Figure 3:
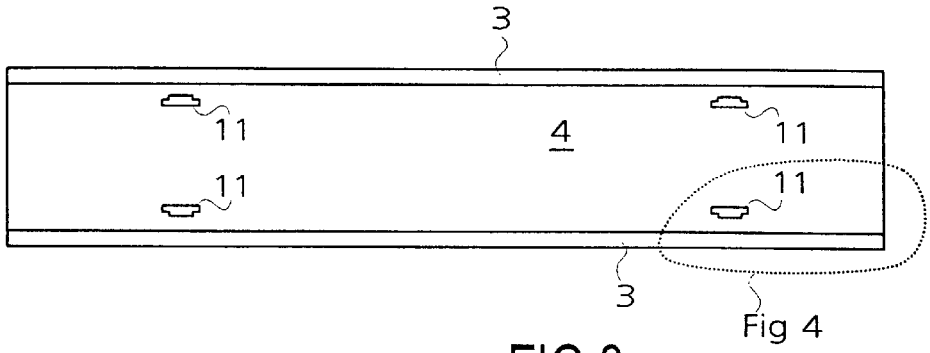
FIG. 3 shows a bare plate viewed from the top.

In FIG. 3, the plate 4 comprises a folded edge 3 on either of its longitudinal sides, in symmetrical fashion, and it is provided with four holes 11. The portion 3 might also be an attached separate piece instead of being folded from the sheeting of the plate itself. It could also be present in certain locations only along the length of the plate at the level of each support piece 8 of FIG. 1.

Figure 4:
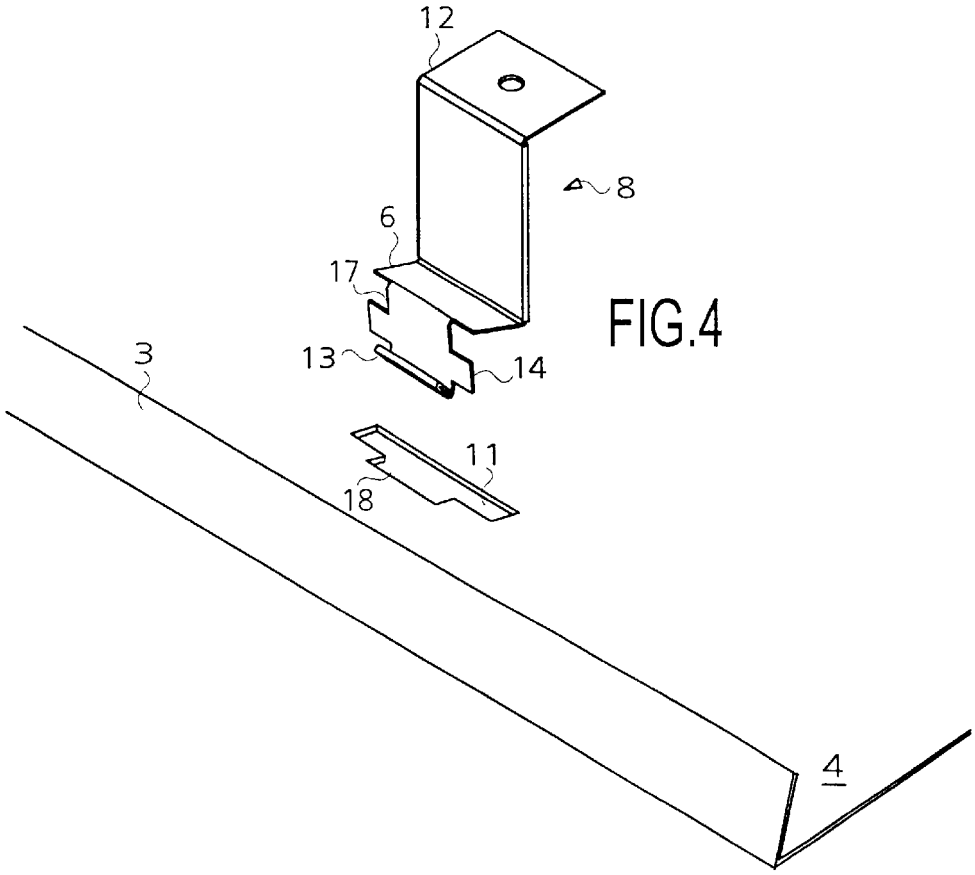
FIG. 4 is a perspective view of a support piece above a portion of a plate.

The portion indicated "FIG. 4" is shown again in FIG. 4 which shows the folded portion 3 and a hole 11 on a larger scale. This rectangular hole comprises a widened portion 18 which has a length smaller than that of the hole itself.

The support piece 8 comprises an upper portion 12, horizontal here, designed for being fixed to the roof 1, and a support portion 6 which is almost horizontal, slightly rising. This support piece 8 furthermore constitutes a hook, having retention means for the plate in the normal position, in addition to the support portion 6: the support portion 6 is lengthened in downward direction by a vertical portion provided with wings 14, the latter portion being further lengthened by a portion 13 which is folded horizontally or slightly rising.

When the plate is in the normal position, the lower portion of the hook enters the slot 11, the hook is pressed to the left in the Figure by its own elasticity, its portion 17 above the wings 14 is inserted into the portion 18 of the slot 11, and the wings 14 retain the plate. When the lower portion of the hook is pushed a little to the right by a user, the plate can be lowered down onto the portion 13. If the lower portion of the hook is pushed more strongly still to the left, the plate can escape from the portion 13 and be completely freed. These means accordingly render possible a partial or total detachment, as desired.

Alternatively, a single wing 14 may suffice, in which case the portion 18 is placed asymmetrically with respect to the slot 11. The relative dimensions of the portions 13, 14, 17 with respect to that of the portion 6 are of little importance because their functions are different. It is easily conceivable, moreover, that the hooks on the one hand, comprising the portions 17, 14, 13, and support portions 6 on the other hand are supported by separate, distinct pieces.

To move the plate from the position of FIG. 1 into that of FIG. 2, the hooks 8L on the left are slightly pushed to the right, which allows the plate to slide past the wings 14 and to descend onto the portion 13, whereupon the hooks 8R on the right are pushed strongly to the left so as to free the plate completely on the right-hand side. While a lateral force is being applied to a hook, the plate, prior to its pivoting, cannot move because it is pressed against the walls of the roof on the right and on the left. The slight downward movement of the left-hand portion of the plate causes its portion 3 to escape from the retention elements 20 and, as indicated by arrow 15, will rest on the portion 6 of the hook, while the plate assembly pivots as indicated by arrow 16.

It should be noted that the verb "comprise" does not exclude the presence of other elements or steps besides those listed in any claim.

What is claimed is:

1. A luminaire comprising a housing of elongate shape with a roof with side walls, which roof is provided with means for fastening to any support, and an elongate plate with longitudinal edges, which plate supports internal functional elements of the luminaire, wherein each of the longitudinal edges is provided with contact portions which engage retention elements in the side walls when the plate is in normal operational position, and the roof is provided with support pieces which are within said housing and opposite said contact portions when the plate is in said normal operational position and which support pieces each have a support portion capable of supporting one of said contact portions of the plate when the plate is detached from the roof and pivoted with respect to the roof.

2. A luminaire as claimed in claim 1, wherein the contact portions are formed by folded edges symmetrically arranged on each of the longitudinal sides of the plate.

3. A luminaire as claimed in claim 1, wherein each of the support pieces in addition forms a hook which comprises, besides the support portion, retention means for the plate in the normal position, which means are of a type which renders possible their detachment whenever desired.

4. A luminaire as claimed in claim 3, wherein said hook comprises a vertical portion arranged below said support portion, provided with at least one wing, and lengthened with a portion which is horizontal or slightly rising.

5. A luminaire as claimed in claim 4, wherein the plate is provided with rectangular openings each designed to receive one of said hooks and comprising a widened portion of a length smaller than that of the opening itself.

6. A luminaire as claimed in claim 1, wherein the plate in its operational position is pressed against the walls of the roof along both its longitudinal sides.

7. A luminaire comprising:

a housing having a roof and a plate which supports internal functional elements of the luminaire and has longitudinal edges, wherein each of the longitudinal edges has contact portions and the roof is provided with support pieces, said support pieces each have a support portion capable of supporting one of the contact portions when the plate is detached from the roof and pivoted with respect to the roof;

wherein each of the support pieces forms a hook;

wherein each said hook comprises a vertical portion arranged below said support portion, provided with at least one wing, and lengthened with a portion which is horizontal or slightly rising;

wherein the plate is provided with rectangular openings each designed to receive one of said hooks and comprising a widened portion of a length smaller than that of the opening itself.

8. A luminaire as claimed in claim 7, wherein the contact portions are formed by folded edges symmetrically arranged on each of the longitudinal sides of the plate.

9. A luminaire as claimed in claim 7, wherein the plate in its operational position is pressed against the walls of the roof along both its longitudal sides.

10. A luminaire comprising:

a housing having a roof with a top wall and side walls;

a plate which supports at least one lamp holder and is movable between an open position and a closed position, said plate being located opposite said top wall and having edges with contact portions which are retained against said side walls in said closed position; and support pieces each having a first end connected to said top wall and a second end with a support portion;

wherein at least one of said support portions contacts one of said contact portions to pivot said plate in said open position.

11. A luminaire comprising:

a housing having a roof with a top wall and side walls;

a plate which supports an element of the luminaire and is movable between an open position and a closed position, said plate being located opposite said top wall and having edges with contact portions which are retained against said side walls in said closed position;

support pieces each having a first end connected to said top wall and a second end with a support portion;

at least one of said support portions contacting one of said contact portions to pivot said plate in said open position, said support pieces further including hooks that extend though rectangular openings of said plate, said rectangular openings comprising widened portions having a first length which is smaller than a second length of the openings.

12. The luminaire device of claim 11, wherein each of said hooks includes a portion which is substantially vertical and extends from said support portion, and a portion which is horizontal or slightly rising.

13. The luminaire of claim 12, wherein said portion which is substantially vertical includes a part having at least one wing that increases a length of said portion which is substantially vertical beyond the length of said portion which is horizontal or slightly rising.

14. The luminaire of claim 13, wherein the length of said portion which is substantially vertical is slightly less than said first length of said widened portions, and said length of the portion which is horizontal or slightly rising is slightly less than said second length of the openings.

15. A luminaire comprising:

a housing having a roof with a top wall and side walls;

a plate which supports an element of the luminaire and is movable between an open position and a closed position, said plate being located opposite said top wall and having edges with contact portions which are retained against said side walls in said closed position;

support pieces each having a first end connected to said top wall and a second end with a support portion;

at least one of said support portions contacting one of said contact portions to pivot said plate in said open position, wherein said support pieces further include hooks each having a portion which is substantially vertical and extends from said support portion, and a portion which is horizontal or slightly rising.

16. A luminaire comprising:

a housing having a roof and side walls;

support pieces attached to said roof;

a plate which is supported by said side walls in a closed position, and supported by said support pieces in an open position; and at least one lamp holder which is connected to said plate, said plate supporting said at least one lamp holder.

17. The luminaire of claim 16, wherein said support pieces each have a support portion capable of supporting a contact portion of the plate when the plate is detached from the side walls and pivoted around the support portion in said open position.

18. The luminaire of claim 16, wherein said side walls have retention elements, and said plate has longitudinal edges with contact portions, wherein said contact portions engage said retention elements of the side walls when the plate is in said closed position.

19. The luminaire of claim 18, wherein said support pieces each have a support portion capable of supporting one of said contact portions of the plate when the plate is detached from the side walls and pivoted around the support portion in said open position.

* * * * *